US006102727A

United States Patent [19]

Kawaguchi et al.

[11] Patent Number: 6,102,727

[45] Date of Patent: Aug. 15, 2000

[54] CONNECTOR EQUIPPED WITH A LOCKING MEMBER

[75] Inventors: Akira Kawaguchi, Tokyo; Noriharu Kurokawa, Kanagawa, both of Japan

[73] Assignee: The Whitaker Corporation, Wilmington, Del.

[21] Appl. No.: 09/288,894

[22] Filed: Apr. 9, 1999

[30] Foreign Application Priority Data

Apr. 15, 1998 [JP] Japan ..... 10-104327

[51] Int. Cl.[7] ..... H01R 13/62

[52] U.S. Cl. ..... 439/372

[58] Field of Search ..... 439/357, 358, 439/361, 370, 372, 142, 144

[56] References Cited

U.S. PATENT DOCUMENTS

| | | | |
|---|---|---|---|
| Re. 29,780 | 9/1978 | Rutkowski | 439/355 |
| 4,607,903 | 8/1986 | Hoshino et al. | 439/370 |
| 4,705,384 | 11/1987 | Mizutani et al. | 355/3 R |
| 5,186,645 | 2/1993 | Bixler | 439/358 |
| 5,464,351 | 11/1995 | Oka | 439/372 |
| 5,613,882 | 3/1997 | Hnatuck et al. | 439/686 |
| 5,951,316 | 9/1999 | Kawano et al. | 439/352 |

FOREIGN PATENT DOCUMENTS

| | | |
|---|---|---|
| 60-218776 | 11/1985 | Japan . |
| 4-274180 | 9/1992 | Japan . |

*Primary Examiner*—Neil Abrams
*Assistant Examiner*—Hae Moon Hyeon

[57] ABSTRACT

The present invention provides an electrical connector equipped with a latching member with the latching member being positioned so that the latching member does not open too far to one side thereby allowing the attachment of other parts in adjacent positions, and the operation of the latching member is also easy. Latching member (30) is mounted on connector housing (2) of electrical connect (1) so that the latching member (30) is free to pivot relative thereto. Tabs (34) on the latching member (30) are oriented at a shallow angle with respect to main body (38) of the latching member (30). Accordingly, when the latching member (30) is moved to an open or unlatched position, the main body (38) is held in a relatively upright state in a prescribed position; then, after the mating connectors (80) have been completely inserted into the connector (1), the latching member (30) is moved to a closed or latched position and is latchably engaged with the connectors (80).

18 Claims, 2 Drawing Sheets

CONNECTOR EQUIPPED WITH A LOCKING MEMBER

FIELD OF THE INVENTION

The present invention relates to an electrical connector, and more specifically it relates to an electrical a connector equipped with a locking or latching member which locks or latches electrical connectors to each other.

BACKGROUND OF THE INVENTION

Electrical connectors are known which have latching members used to latch matable electrical connectors to each other in order to maintain a secure engagement between the connectors. For example, FIG. 5 shows a latching mechanism of an electrical connector disclosed in Japanese Patent Publication No. 60-218776. Pin connector 100 disclosed here has a latching member 102 which is connected by a hinge 104 to the housing thereof, and a slot 106 is located in latching member 102. Meanwhile, a projection 112, which has an extension 114, is located on the housing of a mating socket connector 110. After the two connectors 100, 110 are matably engaged as shown in FIG. 5, the latching member 102 is pivoted toward the projection 112, and the slot 106 is engaged with the extension 114, so that the connectors are latched together.

Furthermore, a connector frame which has a plurality of connector-mounting openings that accommodate connectors is disclosed in Japanese Patent Publication No. 4-274180. In the connector frame, hinge-equipped latching members, which latch the accommodated connectors to the connector frame, are disposed facing the connector mounting openings.

In the conventional example shown in Japanese Patent Publication No. 60-218776, the latching member 102 opens substantially at a right angle with respect to the pin connector 100. Accordingly, in order to place the latching member 102 in a position in which the latching member 102 is engaged with the projection 112, i.e., in a closed or latched position, it is necessary to move the latching member 102 so that the latching member does not interfere with connectors 100, 110 engaging each other. Thus, the operating range is large. Furthermore, in cases where other members are present adjacent the connector, the latching member 102 interferes with the other members, so that the latching operation is difficult; moreover, there is also a danger that the other members may be damaged. In addition, in cases where other members are attached in the vicinity of the latching member 102 after the latching member 102 has been moved to an unlatched or open position, the latching member 102 becomes an obstacle so that such attachment by the other members is difficult.

Furthermore, in the conventional example shown in Japanese Patent Publication No. 4-274180, it is similarly necessary to accomplish latching by pushing the latching members so that they pivot about hinges; accordingly, latching cannot be accomplished simply by pushing in one direction. Furthermore, since the latching members open substantially at right angles to the side of the connector frame, other mounted members cannot be installed. Moreover, since latching is accomplished by pushing respective latching members for a plurality of accommodated connectors, the latching operation requires considerable labor, and it is also burdensome.

SUMMARY OF THE INVENTION

One object of the present invention is to provide a connector equipped with a latching member whereby the latching member is positioned so that the latching member does not open too far to one side, and thus allows the attachment of other mounted parts in adjacent positions, and in which the operation of the latching member is also easy.

Furthermore, another object of the present invention is to provide a connector equipped with a latching member so that a plurality of connectors can easily be latched or unlatched by means of a single operation.

The present invention is directed to a connector equipped with a latching member in which a mating connector is accommodated when the latching member on a housing of the connector is in an open or unlatched position, and the connectors are latched to each other by placing the latching member in a closed or latched position so that the latching member engages with the mating connector, positioning members on the latching member are arranged so that the latching member can be moved from the open position to a closed position merely by moving the latching member in one direction and maintain the latching member in a position that allows engagement with the mating connector.

The latching member can latch or unlatch a plurality of accommodated mating connectors by means of a single operation.

The positioning members are tabs disposed in a vicinity of a pivoting axis of the latching member.

The tabs are formed as integral parts of a main body of the latching member and at a shallow angle.

An electrical connector for mating engagement with a matable electrical connector and being latched together comprises a dielectric housing having a cavity in which the matable electrical connector is received, a latching member pivotally mounted on a side wall of the housing for movement between an open position to enable the matable electrical connector to be inserted into the cavity and a closed position whereby a latching section of the latching member latchably engages the matable electrical connector, and members on the side wall of the housing and the latching member pivotally mounting the latching member on the housing, and a tab on the latching member disposed at an angle with respect to a main body of the latching member which engages the side wall of the housing thereby limiting the movement of the latching member to the open position.

BRIEF DESCRIPTION OF THE DRAWINGS

An embodiment of the present invention will now be described by way of example with reference to the accompanying drawings in which:

FIG. 4A shows a state in which the latching member is in an open position and mating of the mating connectors has begun; FIG. 4B shows a state in which the mating connectors have been completely mated, and the latching member has been moved to a closed position.

DETAILED DESCRIPTION OF THE INVENTION

Figure 1:
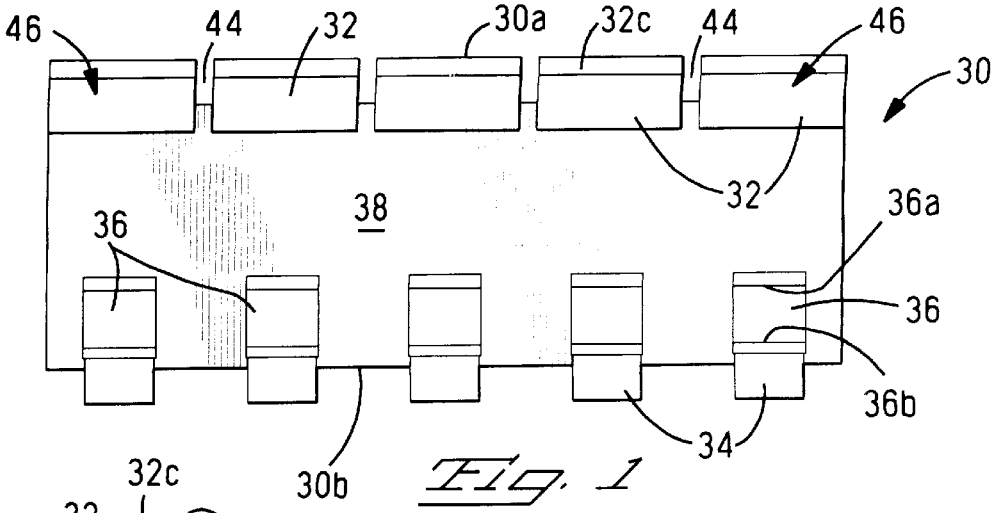
FIG. 1 is a front view showing a latching member of the present invention.
Figure 2:
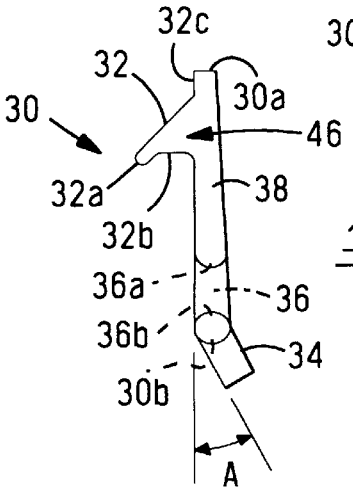
FIG. 2 is a side view of the latching member shown in FIG. 1.

Referring to FIGS. 1 and 2, latching member 30 is a substantially rectangular plate constituting a main body 38, which is formed from a suitable resin. A plurality of latching sections 46, which are divided by slots 44, are located in the vicinity of an upper edge 30*a* of the latching member 30. The respective latching sections 46 have latching projections 32 that extend along the direction of length of the latching member 30. A plurality of positioning tabs 34, which are arranged with a prescribed spacing, are disposed on a lower edge 30*b* of main body 38 of latching member 30. Rectangular openings 36, which are positioned adjacent to the tabs 34, are located above the respective tabs 34. The latching sections 46, tabs 34 and openings 36 have a straight-line positional relationship.

As clearly shown in FIG. 2, the respective latching projections 32 protrude in one direction so that the projections 32 are further removed from the main body 38 of the latching member 30 as the point of reference moves from the upper edge 30*a* toward the lower edge 30*b*. The ends 32*a* of the latching projections 32 are connected to the main body 38 via curved surfaces 32*b*. Flat surfaces 32*c* are located in the areas connecting the upper edge 30*a* to the latching projections 32. The tabs 34 are integral parts of the main body 38 protruding at a shallow angle in the opposite direction from the latching projections 32, so that angle A is approximately 30°. The inside edges 36*a*, 36*b* of the openings 36 have an arcuate shape, and the lower edge 30*b* of the main body 38 has an arcuate shape.

Figure 3:
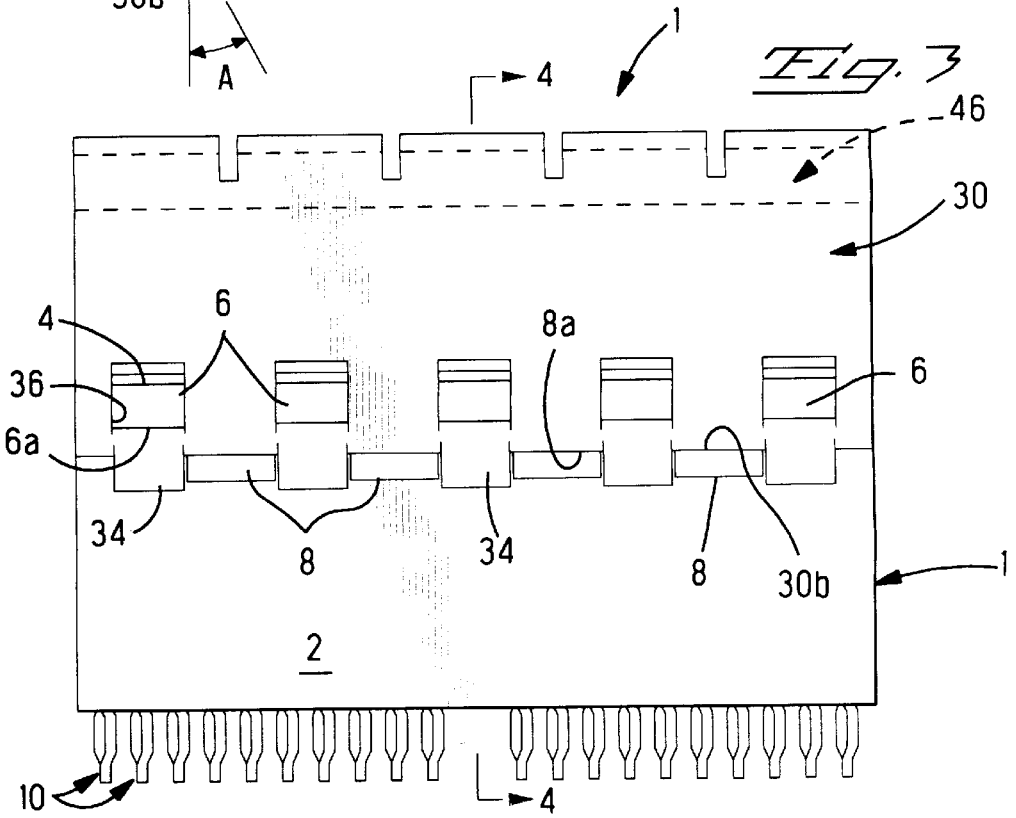
FIG. 3 is a rear view of an electrical connector equipped with the latching member of FIGS. 1 and 2.
Figure 5:
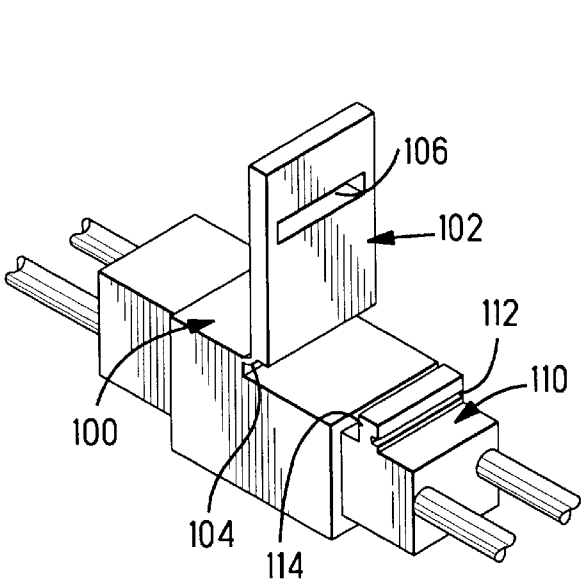
FIG. 5 Prior Art
FIG. 5 is a perspective view showing a conventional electrical connector.
Figure 4B:
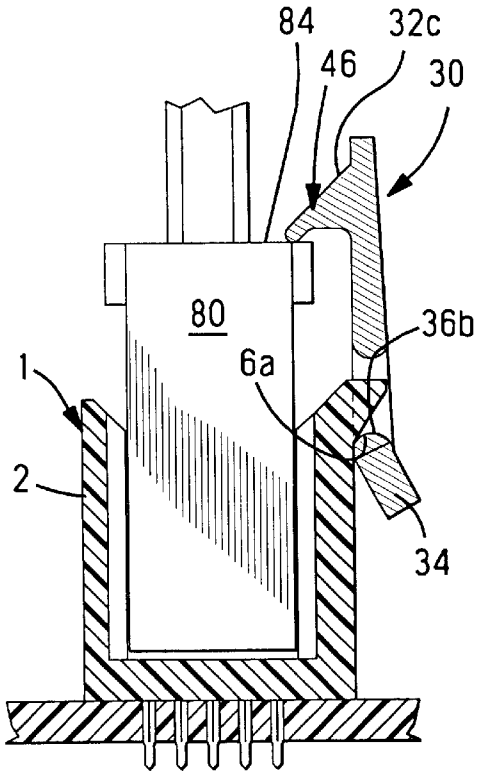
FIGS. 4A and 4B are cross-sectional views taken along line 4—4 in FIG. 3 showing engagement of the connector equipped with the latching member with mating connectors.
Figure 4A:
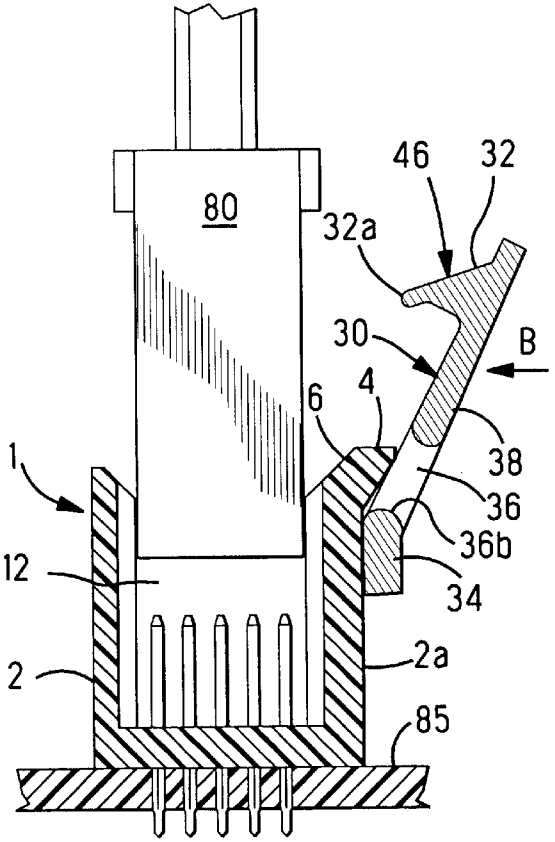

FIG. 3 is a view of electrical connector 1 of the present invention looking from the right of FIG. 4A, in which the latching member 30 is attached to connector housing 2. A plurality of projections 6 and ribs 8 are disposed in staggered positions along the direction of length of the housing 2. The respective projections 6 are aligned with the openings 36 of the latching member 30, and they extend outwardly at an angle with respect to a side wall 2*a* of housing 2 complementary to the angle of tabs 34; the ribs 8 are positioned between the tabs 34. Outer surfaces 6*a* of the projections 6 have a shape that is complementary to the inside edges 36*b* of the openings 36, and the upper surfaces 8a of the ribs 8 have a shape that is complementary to the lower edge 30*b* of the main body 38, i.e., arcuate concave and convex surfaces. The gaps between the respective projections 6 and ribs 8 are set so that the gaps are slightly smaller than the gap between the inside edges 36*b* of the openings 36 in the latching member 30 and the lower edge 30*b* of the latching member 30. Accordingly, when the latching member 30 is positioned onto the housing 2 of the connector as shown in FIG. 4A, the latching member 30 is held in the vicinity of surface 4 of the projection 6. In this case, as a result of the complementary shapes of the projections 6 and ribs 8, the latching member 30 can pivot in the direction perpendicular to the plane of the page. Thus, a portion of the main body 38 extending along the direction of length of the latching member 30 between the lower edge 30*b* and the inside edges 36*b* acts as the pivoting axis. Electrical contacts 10 are secured in a bottom wall of housing 2. In the present embodiment, the connectors 80 that are inserted (see FIG. 4) are five in number, and the latching sections 46 are positioned facing each of the five connectors 80.

The operation of the latching member 30 will now be described with reference to FIGS. 4A and 4B. FIG. 4A shows a state in which a connector 1 attached to a circuit board 85 has begun to accommodate mating connectors 80. FIG. 4B shows a state in which the connectors 80 have been completely accommodated within connector 1 and latched thereto by means of the latching member 30. First, referring to FIG. 4A, the latching member 30 is placed in a position in which the latching member is pivoted to a non-latching position so that it does not interfere with the insertion of the mating connectors 80 into connector 1, i.e., the latching member 30 is placed at an open or unlatched position. The connectors 80 are smoothly inserted and enter the cavity 12 of the housing 2. Furthermore, matable electrical contacts (not shown) which are connected to the electrical contacts 10 are disposed in the connectors 80. In this case, as a result of the tabs 34 of the latching member 30 engaging side wall 2*a* of the housing 2, the main body 38 is maintained by gravity in a relatively upright position at a prescribed angle, i. e. approximately 30° in the case of the present embodiment. As a result, the latching member 30 does not open to an angle of 90° relative to the side wall 2*a* of the housing; accordingly, other mounted parts not shown can be disposed on the board 85 in the vicinity of the connector 1 on the side of the latching member 30.

When the latching member 30 is simply moved in one direction, i.e., in the direction indicated by arrow B, after the connectors 80 have been completely inserted, the ends 32*a* of the latching projections 32 are positioned on back surfaces 84 of the connectors 80, i.e., the latching projections 32 are engaged with the connector 80 in a closed or latched position of the latching member 30, as shown in FIG. 4B. As a result, the connectors 80 are prevented from slipping out of connector 1. In this case, the inside edges 36*b* of the openings 36 and the lower edge 30*b* of the main body 38 of the latching member 30 are respectively clamped by the outer surfaces 6*a* of the projections 6 and the upper surfaces 8*a* of the ribs 8, so that the latching member does not fall off the housing 2. In order to release the engagement of the latching member 30 from the connectors 80, it is necessary merely to place fingers on the flat surface 32*c* and move the latching member 30 to the open position. Thus, a plurality of mating connectors 80 can be latched or unlatched at one time by means of a single operation, and the operation of the latching member 30 is easy. Furthermore, assembly by machine is also possible.

The present invention has been described in detail above. However, the described embodiment is merely an example; the present invention is not limited to such example. It would also be possible to form a continuous latching projection without slots 44 instead of a plurality of latching sections 46. Furthermore, the angle between the tabs and the main body is not limited to 30° ; any desired shallow angle may be selected, preferably within the range of 30° +5°, as long as the angle allows engagement with the connectors 80 by moving the latching member 30 in one direction.

In the connector equipped with a latching member provided by the present invention, positioning members are arranged so that the latching member can be moved from an open position to a closed position merely by moving the latching member in one direction, and they hold the latching member in a position that allows engagement with a mating connector. Accordingly, the latching member is positioned so that the latching member does not open too far to one side; this allows other parts to be attached in positions adjacent to the connector. The latching operation is also easy.

What is claimed is:

1. An electrical connector for mating engagement with a matable electrical connector and being latched together comprising:

a dielectric housing having a cavity in which the matable electrical connector is received;

a side wall of the dielectric housing having a projection;

ribs extending outwardly from the side wall;

a latching member having a main body provided with a rectangular opening;

a latching section at an upper end of the main body having a latching projection;

a tab of the main body adjacent the rectangular opening and being disposed at an angle with respect to the main body;

a lower edge of the main body disposed on the ribs pivotally mounting the latching member on the dielectric housing thereby enabling the latching member to move from an open position with the tab engaging the side wall of the housing and the latching section is clear of the cavity so that the matable electrical connector can be inserted into the cavity to a closed position whereby the projection is disposed in the rectangular opening, the latching projection of the latching section is in engagement with the matable electrical connector and the tab is spaced from the side wall.

2. An electrical connector as claimed in claim 1, wherein the projection of the side wall of the housing is disposed at an angle complementary to the angle of the tab.

3. An electrical connector as claimed in claim 1, wherein the ribs have an arcuate surface complementary to the arcuate surface of the lower edge of the main body.

4. An electrical connector as claimed in claim 1, wherein a lower surface of the rectangular opening has an arcuate shape.

5. An electrical connector as claimed in claim 1, wherein the tab is in alignment with the rectangular opening.

6. An electrical connector for mating engagement with a matable electrical connector and being latched together comprising a dielectric housing having a cavity in which the matable electrical connector is received, a latching member pivotally mounted on a side wall of the housing for movement between an open position to enable the matable electrical connector to be inserted into the cavity and a closed position whereby a latching section of the latching member latchably engages the matable electrical connector, and ribs on the side wall of the housing and the latching member pivotally mounting the latching member on the housing, and a tab on the latching member disposed at an angle with respect to a main body of the latching member which engages the side wall of the housing thereby limiting the movement of the latching member to the open position.

7. An electrical connector as claimed in claim 6, wherein the side wall has a projection disposed at an angle complementary to the angle of the tab.

8. An electrical connector as claimed in claim 7, wherein the main body has a rectangular opening in which the projection is disposed when the latching member is in the closed position.

9. An electrical connector as claimed in claim 7, wherein the members comprise ribs extending outwardly from the side wall on each side of the projection and a lower edge of the main body.

10. An electrical connector as claimed in claim 9, wherein the ribs and the lower edge have complementary arcuate surfaces.

11. An electrical connector as claimed in claim 8, wherein a lower surface of the rectangular opening has an arcuate surface.

12. An electrical connector as claimed in claim 8, wherein the tab is in alignment with the rectangular opening.

13. A latching member mounted onto a dielectric housing of an electrical connector for latching a matable electrical connector to the electrical connector comprising:

a main body having a latching section at an upper end;

a lower edge of the main body pivotally mounted onto ribs extending outwardly from a side wall of the dielectric housing enabling the latching member to move from an open position permitting the matable electrical connector to be inserted into a cavity of the dielectric housing and a closed position whereby the latching section engages the matable electrical connector and latches it to the electrical connector; and a tab on the main body disposed at an angle with respect to the main body which engages the side wall of the dielectric housing thereby limiting the movement of the latching member to the open position.

14. A latching member as claimed in claim 13, wherein the main body has an opening.

15. A latching member as claimed in claim 14, wherein the side wall has a projection disposed at an angle complementary to the angle of the tab, the projection is disposed in the opening when the latching member is in the closed position.

16. A latching member as claimed in claim 13, wherein the lower edge of the main body and the ribs have complementary arcuate surfaces.

17. A latching member as claimed in claim 14, wherein the tab is in alignment with the opening.

18. A latching member as claimed in claim 17, wherein a lower surface of the opening has an arcuate surface.

* * * * *